US006083050A

United States Patent [19]

Hsu

[11] Patent Number: 6,083,050

[45] Date of Patent: Jul. 4, 2000

[54] LAMP SOCKET ADAPTER FOR MOUNTING IN A LAMP SOCKET TO HOLD A LAMP BULB

[76] Inventor: Min-Hsun Hsu, No. 3, Lane 49, Hsao-Nien St., Hsin-Chu City, Taiwan

[21] Appl. No.: 09/276,649

[22] Filed: Mar. 26, 1999

[51] Int. Cl.[7] ..... H01R 17/00

[52] U.S. Cl. ..... 439/619; 439/699.2

[58] Field of Search ..... 439/617, 619, 439/699.2, 611, 638–655

[56] References Cited

U.S. PATENT DOCUMENTS

| | | | |
|---|---|---|---|
| 4,603,278 | 7/1986 | Devir et al. | 439/619 |
| 4,724,353 | 2/1988 | Devir | 439/619 |
| 4,883,434 | 11/1989 | Toyoshima | 439/619 |
| 5,008,588 | 4/1991 | Nakahara | 439/619 |
| 5,456,620 | 10/1995 | Kaminski | 439/619 |
| 5,865,647 | 2/1999 | Garber et al. | 439/699.2 |

*Primary Examiner*—Hien Vu
*Attorney, Agent, or Firm*—Rosenberg, Klein & Lee

[57] ABSTRACT

A lamp socket adapter installed in a lamp socket in a motor vehicle to hold a lamp bulb having a glass base which includes a casing, the casing having a receiving chamber, which receives the glass base of the lamp bulb, a plurality of inside retaining blocks engaged with respective retaining blocks at two opposite sides of the glass base of the lamp bulb, two pairs of bottom holes through which lead-out wires of the lamp bulb are extended out of the casing, two transverse coupling grooves symmetrically disposed at two first opposite outside walls thereof, which are engaged with hooked portions of respective protruding plates inside the lamp socket, and two locating blocks respectively raised from two second opposite outside walls thereof between the transverse coupling grooves and respectively engaged into respective longitudinal locating grooves inside the lamp socket, and a plug plate formed integral with the bottom side wall of the casing and inserted into the lamp socket, the plug plate having two pairs of locating notches bilaterally disposed at one end thereof remote from the casing which receive respective terminal ends of the lead-out wires of the lamp bulb, enabling the lead-out wires of the lamp bulb to be retained in contact with respective conductor terminals in the lamp socket.

1 Claim, 7 Drawing Sheets

LAMP SOCKET ADAPTER FOR MOUNTING IN A LAMP SOCKET TO HOLD A LAMP BULB

BACKGROUND OF THE INVENTION

The present invention relates to a lamp socket adapter for mounting in a lamp socket in a motor vehicle to hold a lamp bulb.

A motor vehicle is equipped with a variety of lamps including driving lights, side lights, stop lights, etc. These lamps are designed for different purposes, or for use at different conditions. A motor vehicle lamp is generally comprised of a lamp socket, and a lamp bulb installed in the lamp socket. FIG. 1*a* and FIG. 1*b* show two different lamp sockets for different lamp bulbs, namely, the first type of lamp socket (a) for use in a Japanese motor vehicle to hold a corresponding lamp bulb, and the second type of lamp socket (b) for use in a Western motor vehicle to hold another type of lamp bulb. FIG. 2 shows a lamp bulb 10 for use with the first type of lamp socket (a). This structure of lamp bulb 10 comprises a glass base 12, which has a plurality of retaining blocks 14 raised from its two opposite sides for engagement with respective retaining portions (not shown) inside the lamp socket 18 (the aforesaid first type of lamp socket (a)), and a plurality of lead-out wires 16, which are extended out of the glass base 12 for contacting with respective conductor terminals 20 in the lamp socket 18. This structure of lamp bulb 10 is designed for use with the aforesaid first type of lamp socket (a) only. It cannot be used with the aforesaid second type of lamp socket (b).

SUMMARY OF THE INVENTION

The present invention has been accomplished under the circumstances in view. The present invention provides a lamp socket adapter which enables a lamp bulb designed for use with the aforesaid first type of lamp socket for use in a Japanese motor vehicle to be used with the aforesaid second type of lamp socket for use in a Western motor vehicle. To achieve this object, there is provided a lamp socket adapter fastened to a lamp socket to hold a lamp bulb having a glass base, the lamp socket adapter comprising a casing and a plug plate formed integral with the bottom side wall of the casing. The casing comprises a receiving chamber, which receives the glass base of the lamp bulb, a plurality of inside retaining blocks engaged with respective retaining blocks at two opposite sides of the glass base of the lamp bulb, two pairs of bottom holes through which lead-out wires of the lamp bulb are extended out of the casing, two transverse coupling grooves symmetrically disposed at two first opposite outside walls thereof, which are engaged with hooked portions of respective protruding plates inside the lamp socket, and two locating blocks respectively raised from two second opposite outside walls thereof between the transverse coupling grooves and respectively engaged into respective longitudinal locating grooves inside the lamp socket The plug plate comprises two pairs of locating notches bilaterally disposed at one end thereof remote from the casing which receive respective terminal ends of the lead-out wires of the lamp bulb, enabling the lead-out wires of the lamp bulb to be retained in contact with respective conductor terminals in the lamp socket.

DETAILED DESCRIPTION OF THE PREFERRED EMBODIMENT

Figure 1A:
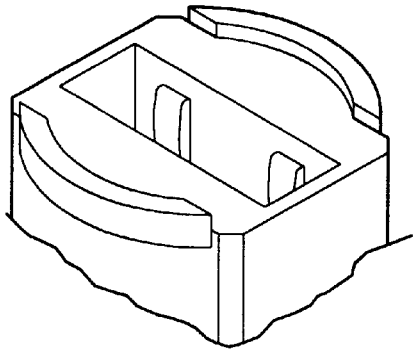
FIG. 1A (PRIOR ART)
FIG. 1*a* and FIG. 1*b* illustrates two different motor vehicle lamp sockets according to the prior art.
Figure 1B:
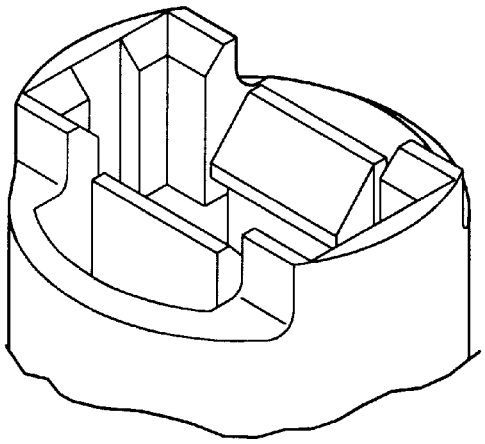
FIG. 1B (PRIOR ART)
Figure 2:
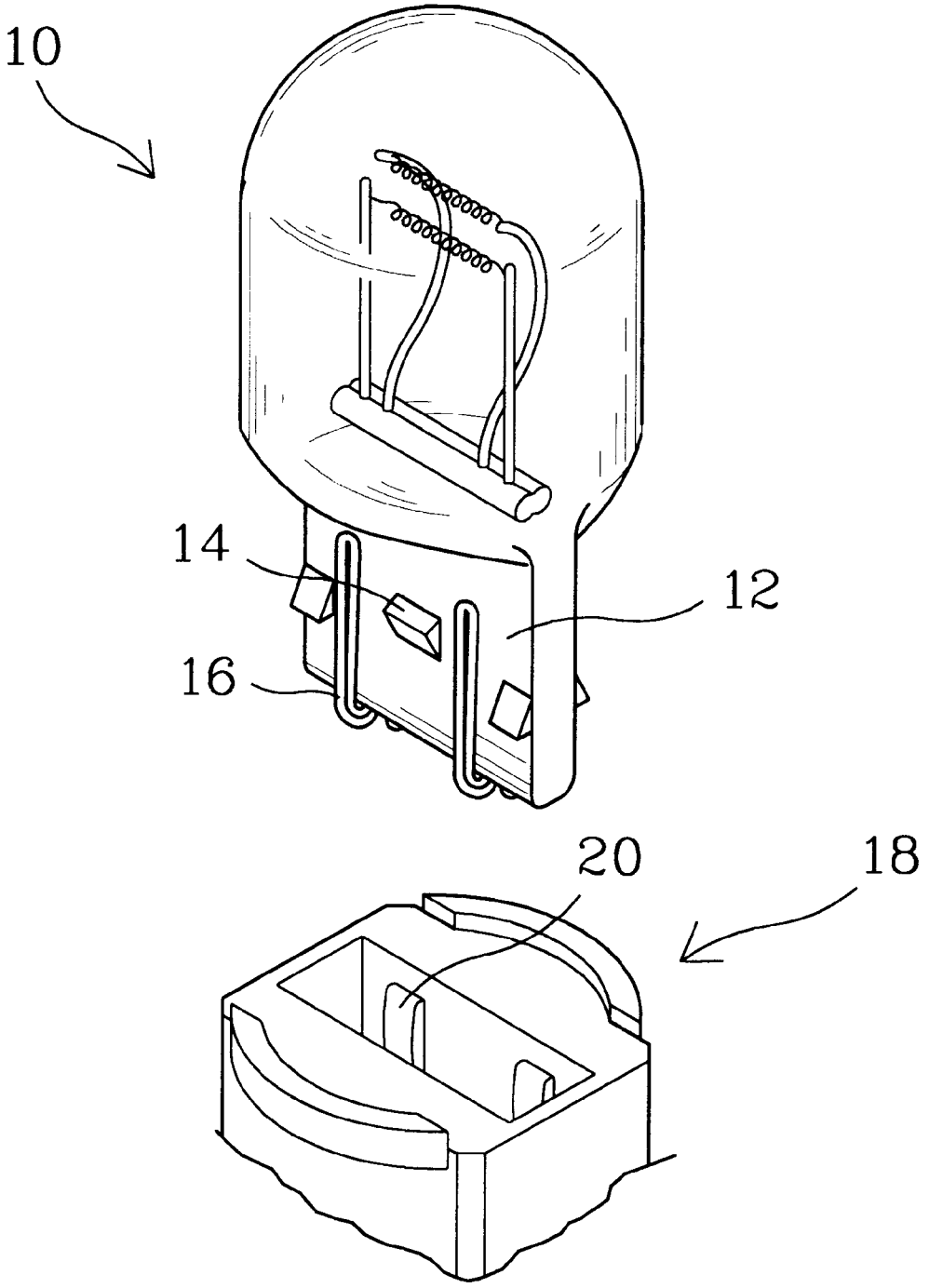
FIG. 2 is an exploded view of a lamp bulb and a lamp socket according to the prior art.
Figure 3:
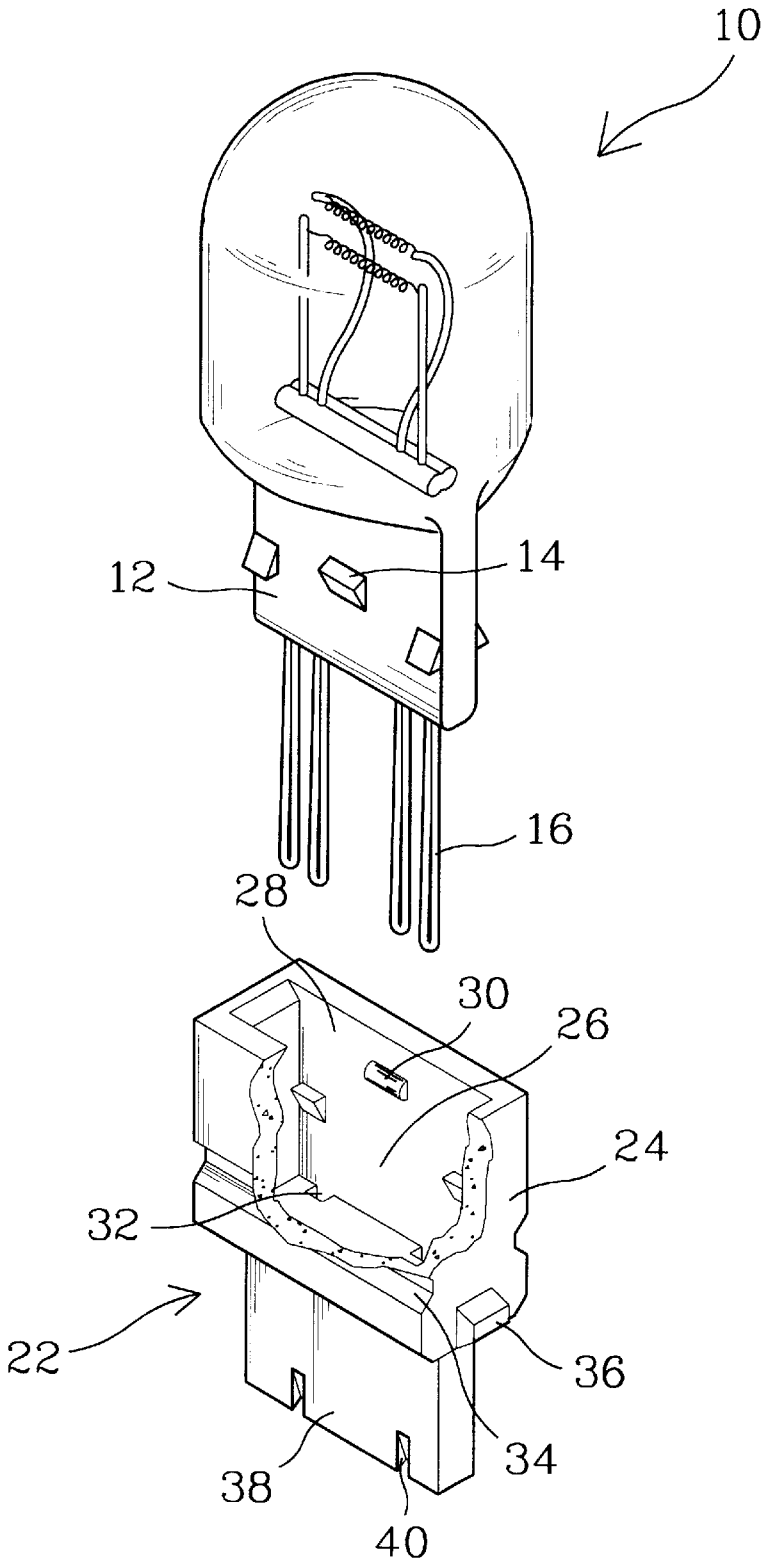
FIG. 3 illustrates a lamp bulb and cutaway view of a lamp socket adapter according to the present invention.

Referring to FIG. 3, a lamp socket adapter 22 is shown comprised of a casing 24, and a plug plate 38 formed integral with the bottom wall of the casing 24. The casing 24 comprises a receiving chamber 26 for receiving the glass base 12 of a lamp bulb 10, a plurality of first retaining blocks 30 symmetrically raised from two parallel inside walls 28 thereof inside the receiving chamber 26 for engagement with respective second retaining blocks 14 at two opposite sides of the glass base 12 of the lamp bulb 10, two pairs of through holes 32 axially extended through the bottom wall of the receiving chamber 26 at two opposite sides adjacent to the inside walls 28 for receiving the lead-out wires 16 of the lamp bulb 10, two transverse coupling grooves 34 symmetrically disposed at two first opposite outside walls thereof, and two locating blocks 36 respectively raised from two second opposite outside walls thereof between the transverse coupling grooves 34. The plug plate 38 comprises two pairs of locating notches 40 bilaterally disposed at the end thereof remote from the casing 24 corresponding to the through holes 32 at the casing 24. The locating notches 40 respectively slope inwards, each having a width gradually reducing from the inner side toward the outer side.

Figure 4:
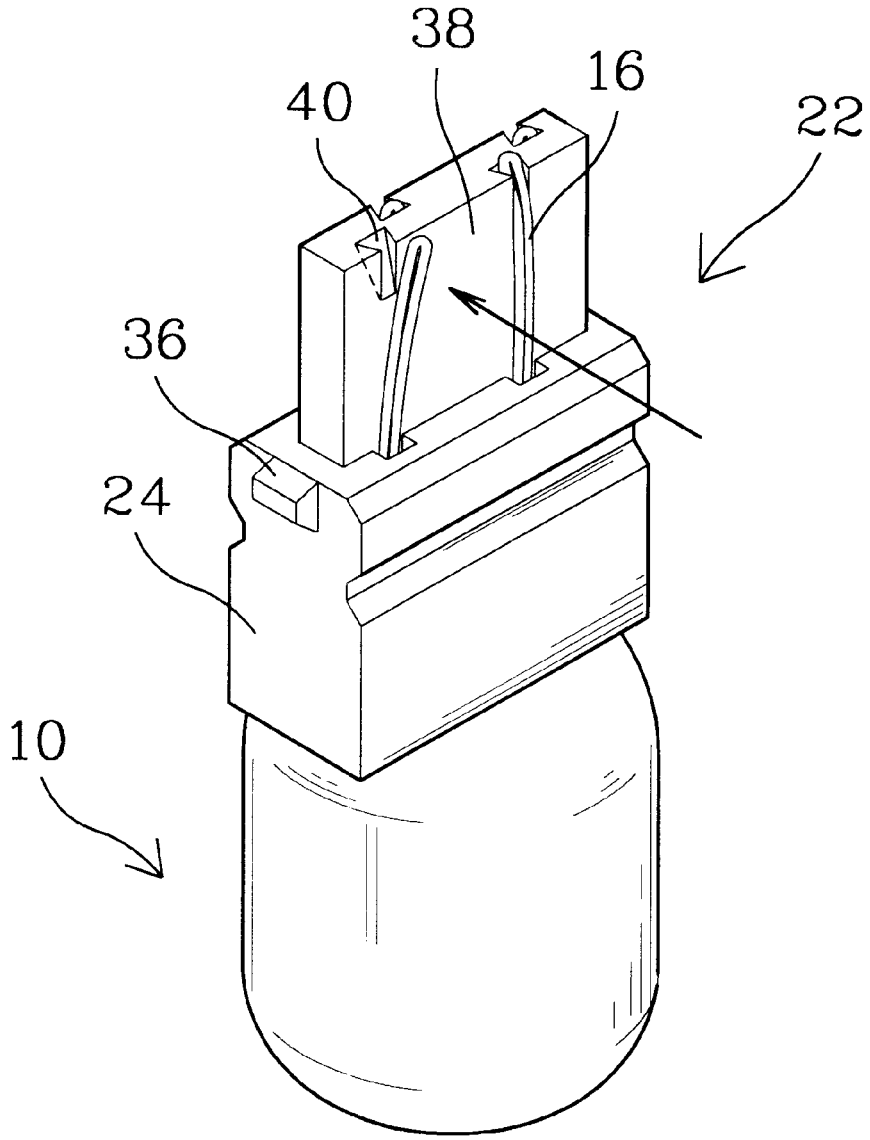
FIG. 4 shows the installation of the lamp bulb in the lamp socket adapter according to the present invention.
Figure 5:
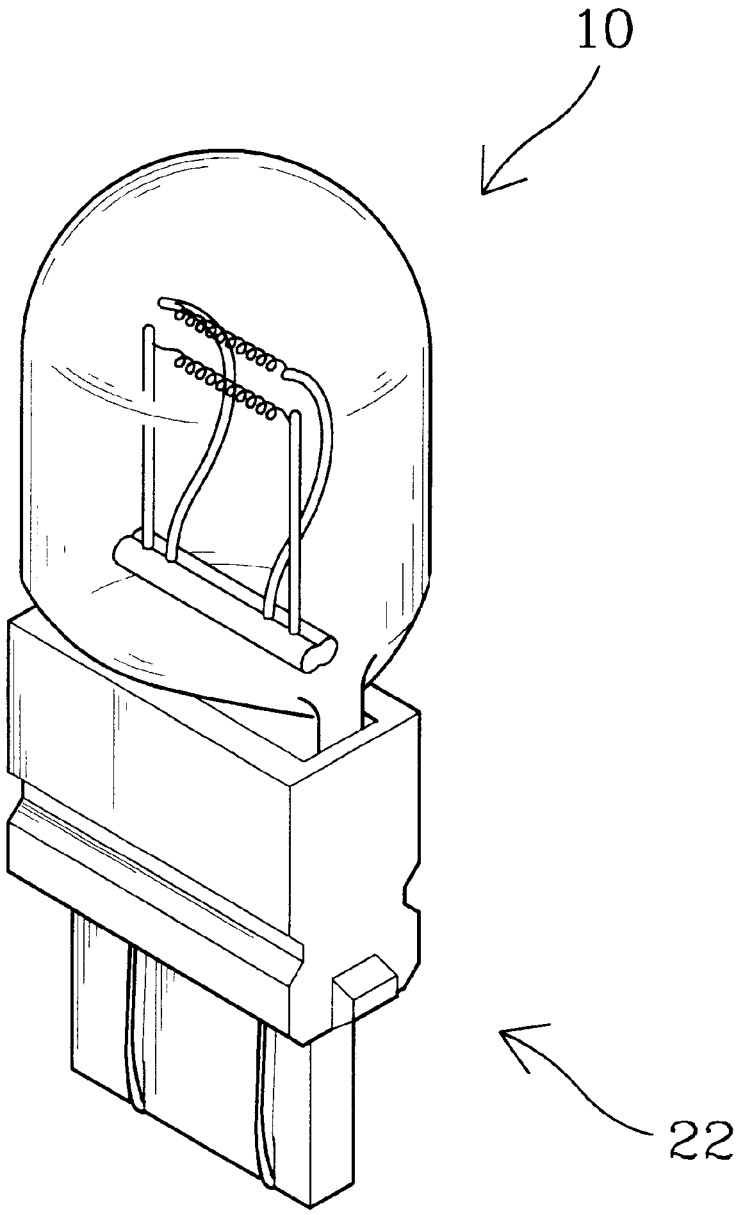
FIG. 5 illustrates the lamp bulb installed in the lamp socket adapter according to the present invention.

Referring to FIGS. 4 and 5 and FIG. 3 again, when the glass base 12 of the lamp bulb 10 is plugged into the receiving chamber 26 at the casing 24, the second retaining blocks 14 at the glass base 12 of the lamp bulb 10 are respectively forced into engagement with the first retaining blocks 30 inside the receiving chamber 26 to stop the lamp bulb 10 from backward movement relative to the casing 24, and the lead-out wires 16 of the lamp bulb 10 are respectively inserted through the through holes 32 at the casing 24 with the respective tail ends of the lead-out wires 16 respectively positioned in the locating notches 40 at the plug plate 38.

Figure 6:
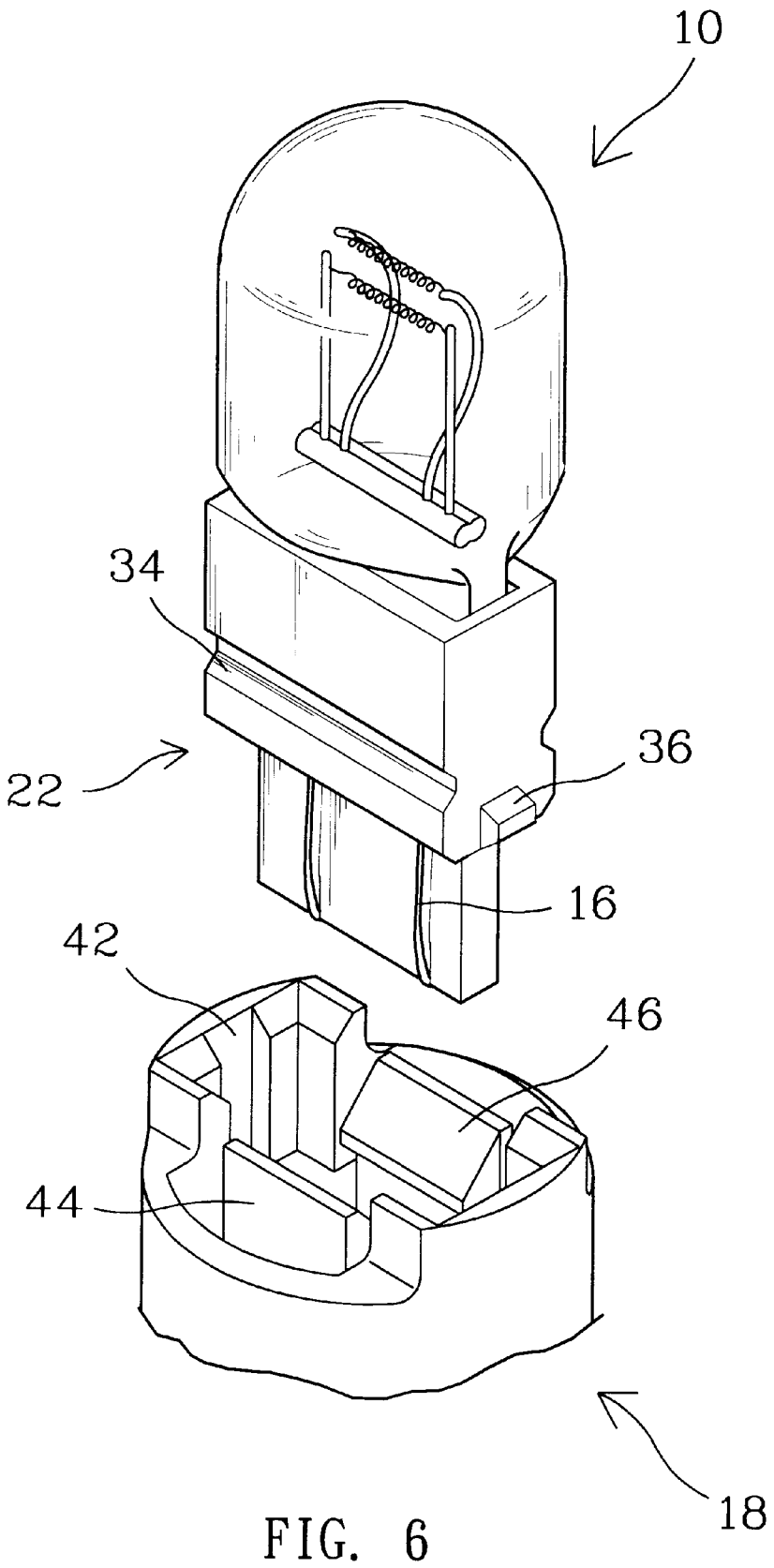
FIG. 6 shows the relationship between the lamp socket adapter and the lamp socket according to the present invention.
Figure 7:
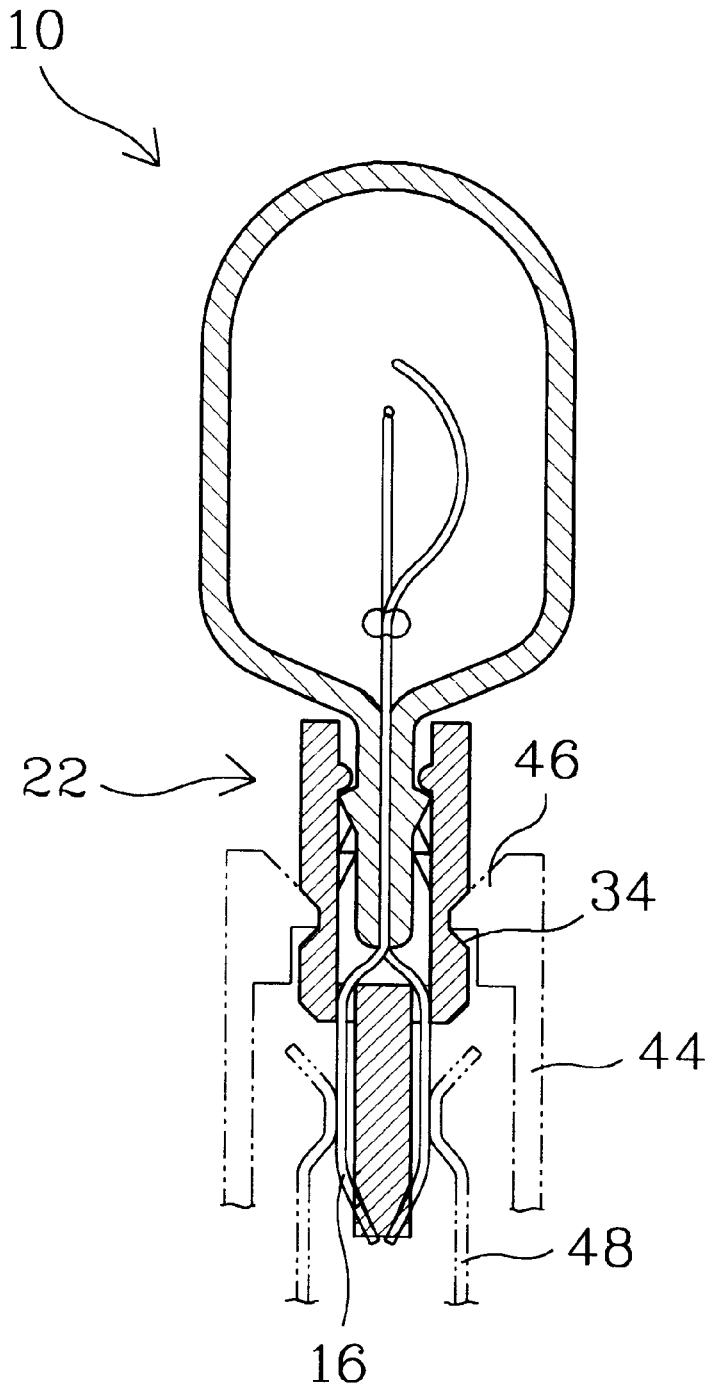
FIG. 7 is a sectional view showing the lamp socket adapter installed in the lamp socket, the lead-out wires of the lamp bulb retained in contact with respective conductor terminals in the lamp socket according to the present invention.

Referring to FIGS. 6 and 7, after installation of the lamp bulb 10 in the casing 24 of the lamp socket adapter 22, the lamp socket adapter 22 is inserted into the matching lamp socket 18, enabling the locating blocks 36 to be respectively engaged into two longitudinal locating grooves 42 inside the lamp socket 18 and the transverse coupling grooves 34 to be respectively forced into engagement with the hooked portions 46 of the two protruding plates 44 inside the lamp socket 18. After installation of the lamp socket adapter 22 in the lamp socket 18, the lead-out wires 16 of the lamp bulb 10 are retained in contact with respective conductor terminals 48 in the lamp socket 18. Therefore, the lamp bulb 10 is turned on when the lamp socket 18 is electrically connected.

While only one embodiment of the present invention has been shown and described, it will be understood that various modifications and changes could be made thereunto without departing from the spirit and scope of the invention disclosed.

What the invention claimed is:

1. A lamp socket adaptor for converting a wedge-base bulb used in a first automotive application to an insulated base lamp used in a second automotive application, said adapter comprising:

a casing having a chamber formed therein for receiving a glass base portion of the wedge-base bulb, said chamber being formed between a pair of parallel side walls and parallel end walls of said casing, each of said pair of side walls having a plurality of first retaining blocks extending into said chamber for matingly engaging corresponding second retaining blocks formed on opposing sides of the glass base portion of the wedge-base bulb, said chamber having a bottom wall with two pairs of openings formed therethrough, each pair of said opening being located adjacent a respective one of said pair of side walls for passage therethrough of respective lead-out wires of the wedge-base bulb, said casing having a pair of coupling grooves respectively formed in an outer surface of said pair of side walls for coupling with respective protruding plates of an automotive lamp socket for the second automotive application, each of said end walls having a locating block formed on an outer surface thereof for insert into respective locating grooves of the automotive lamp socket for the second automotive application; and, a plug plate extending from an outer surface of said bottom wall and being located between said two pairs of openings, said plug plate having two pairs of locating notches formed adjacent a distal end thereof, said two pairs of locating notches being respectively formed in opposing side faces of said plug plate in respective aligned relationship with said two pairs of openings for receiving corresponding distal ends of the lead-out wires therein, each of said locating notches is inwardly inclined and having a width dimension at an inner side thereof greater than a width dimension at an outer side of said locating notch for retaining the distal end of a respective lead-out wire in an inwardly inclined contour therein.

* * * * *